US007053841B2

(12) United States Patent
Ponce De Leon et al.

(10) Patent No.: US 7,053,841 B2
(45) Date of Patent: May 30, 2006

(54) PARASITIC ELEMENT AND PIFA ANTENNA STRUCTURE

(75) Inventors: Lorenzo A. Ponce De Leon, Lake Worth, FL (US); Robert A. Kroegel, Boynton Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/631,233

(22) Filed: Jul. 31, 2003

(65) Prior Publication Data

US 2005/0024272 A1 Feb. 3, 2005

(51) Int. Cl.
*H01Q 1/24* (2006.01)

(52) U.S. Cl. ..... 343/702; 343/700 MS

(58) Field of Classification Search ..... 343/700 MS, 343/702, 846

See application file for complete search history.

(56) References Cited

U.S. PATENT DOCUMENTS 4,862,181 A 8/1989 Ponce de Leon et al. ..... 343/700 MS
6,326,921 B1 * 12/2001 Egorov et al. ..... 343/700 MS
6,348,897 B1 * 2/2002 Alameh et al. ..... 343/702
6,614,400 B1 * 9/2003 Egorov ..... 343/702
6,697,023 B1 * 2/2004 Tiao-Hsing et al. ..... 343/702
6,714,162 B1 * 3/2004 Kadambi et al. .... 343/700 MS
6,930,641 B1 * 8/2005 Ohara et al. ..... 343/702
2003/0201943 A1 * 10/2003 Kadambi et al. ..... 343/702

* cited by examiner

*Primary Examiner*—Tho Phan

(57) ABSTRACT

A Parasitic Element (202) for use in combination with a Planer Inverted "F" Antenna (PIFA) (100) that creates an additional band of efficient operation for the combined antenna structure (200). The parasitic element (202) is able to be made to conform to surfaces (704) that are near the PIFA, such as of a case (704) of a cellular telephone (706). The parasitic element (202) is positioned so as to radiantly couple with the PIFA (100) in order to create the additional band of efficient operation. A parasitic element (202) is used with a dual band PIFA that operates in two RF bands, such as in the region near 800 MHz and 1.9 GHz, and adds a third band such as in the region near 1.575 GHz to support reception of Global Positioning System signals. This parasitic element (202) can conform to a case (704) of the cellular telephone (706).

13 Claims, 4 Drawing Sheets

100

200

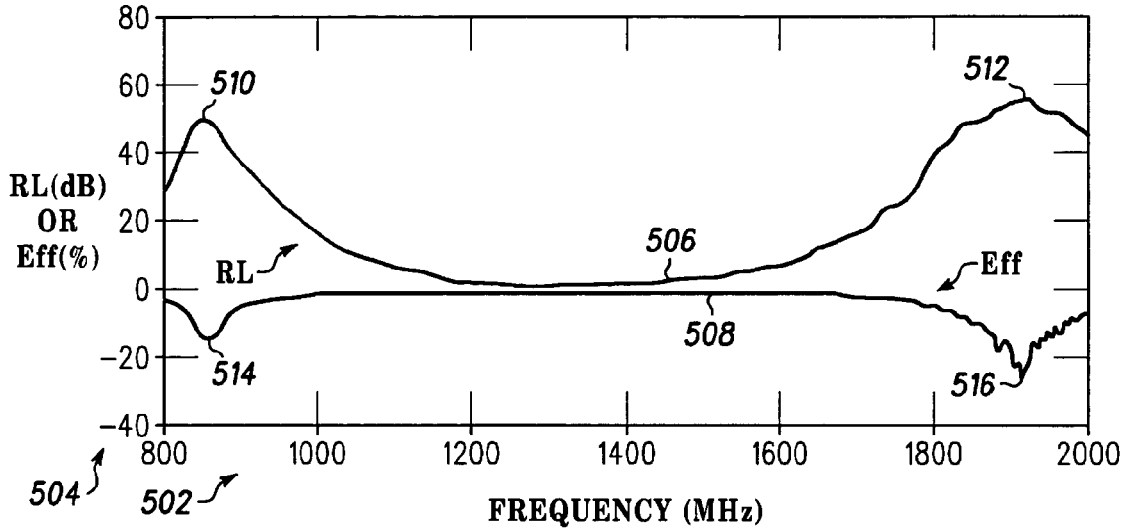
500 FIG. 5
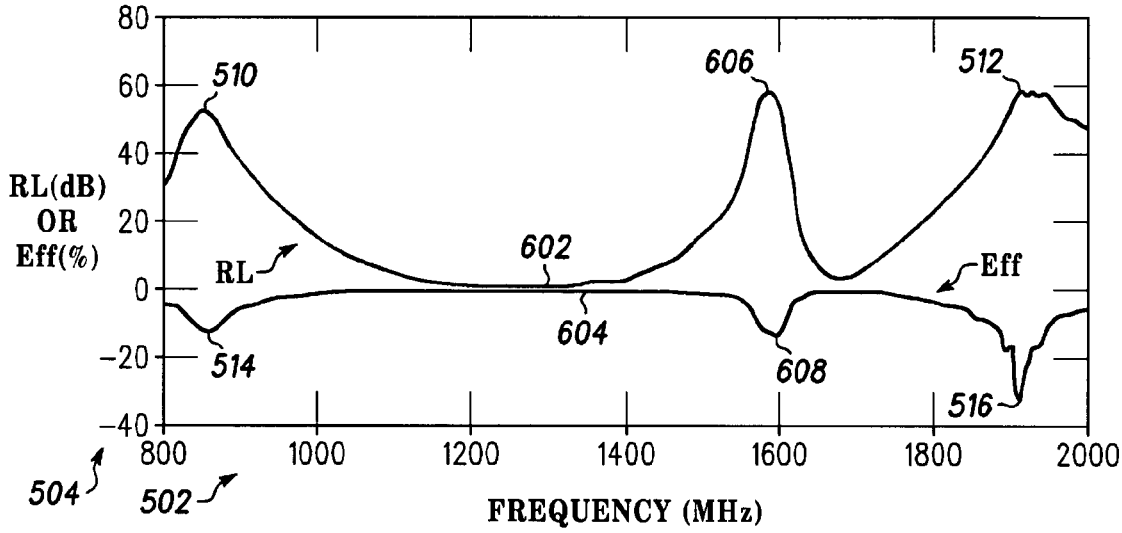
600 FIG. 6
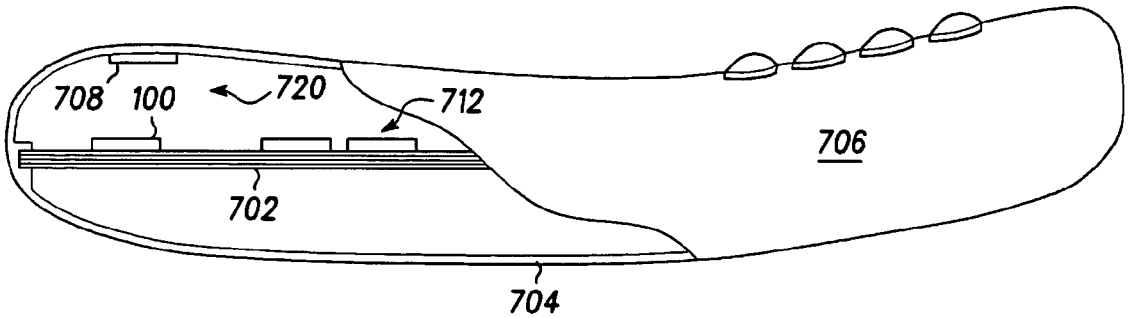
700 FIG. 7

800

900

PARASITIC ELEMENT AND PIFA ANTENNA STRUCTURE

FIELD OF THE INVENTION

The present invention generally relates to the field of radio frequency antennas and more particularly to compact, multiple band antennas.

BACKGROUND OF THE INVENTION

Radio communications devices are increasingly being used to communicate through and process RF signals within multiple RF bands. An example of multiple RF band devices is a device that is able to communicate in one of several cellular telephone bands, such as the 800 MHz band and the 1.9 GHz Cellular telephone band, while receiving Global Positioning System (GPS) signals in the region of 1.575 GHz. It is often desirable, especially in small and/or portable devices, to minimize the number of antennas that are used on the device, and using a single antenna to cover multiple bands generally provides savings in size and manufacturing cost.

One antenna design used in cellular telephones that operate within two RF bands is a Planar Inverted "F" Antenna (PIFA). A PIFA is able to efficiently operate in two cellular bands, such as the 800 MHz and 1.9 GHz RF bands. In cellular phone devices that operate in these two bands, however, a separate antenna is generally used to receive GPS signals in the region of 1.575 GHz. This increases the size, cost and complexity of cellular phones that operate in these two cellular bands and that are required to receive GPS signals.

Therefore a need exists to overcome the problems with the prior art as discussed above.

SUMMARY OF THE INVENTION

According to a preferred embodiment of the present invention, an antenna has a PIFA and a parasitic element positioned so as to be operatively coupled to the PIFA. The parasitic element is positioned in proximity to the PIFA so that RF energy is coupled between the parasitic element and the PIFA. The parasitic element is also configured and positioned so as to further induce radiation within one or multiple additional frequency bands.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 5 is an exemplary PIFA antenna only radiation characteristic verses RF frequency of a PIFA antenna operating without a parasitic element, according to a preferred embodiment of the present invention.

FIG. 6 is exemplary PIFA-Parasitic Element combination antenna structure radiation characteristic verses RF frequency according to a preferred embodiment of the present invention.

FIG. 7 is a cross-sectional view of a cellular telephone incorporating a PIFA-Parasitic Element antenna structure according to an alternative embodiment of the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

The present invention, according to a preferred embodiment, overcomes problems with the prior art by providing a Parasitic Element (PE) that is able to be used in conjunction with a Planer Inverted "F" antenna (PIFA) antenna structure. In some embodiments of the present invention, the PE physically conforms to, and is therefore easily mounted upon, a physical structure that is near the PIFA antenna. This facilitates fabrication of a device incorporating those embodiments of the present invention. The PE of the exemplary embodiment is configured and positioned so as to induce an additional RF band of efficient operation in the PIFA when operating as a combined PIFA-PE antenna structure as compared to the operation of the PIFA alone. The exemplary embodiment uses a PIFA antenna that is suited for dual cellular telephone RF band use within the 800 MHz and 1.9 GHz bands. The PE of the exemplary embodiment adds an additional band of efficient reception of GPS signals in the region of 1.575 GHz. The exemplary embodiment provides a single compact antenna structure that efficiently operates in the 800 MHz, 1.575 GHz and 1.9 GHz bands.

Figure 1:
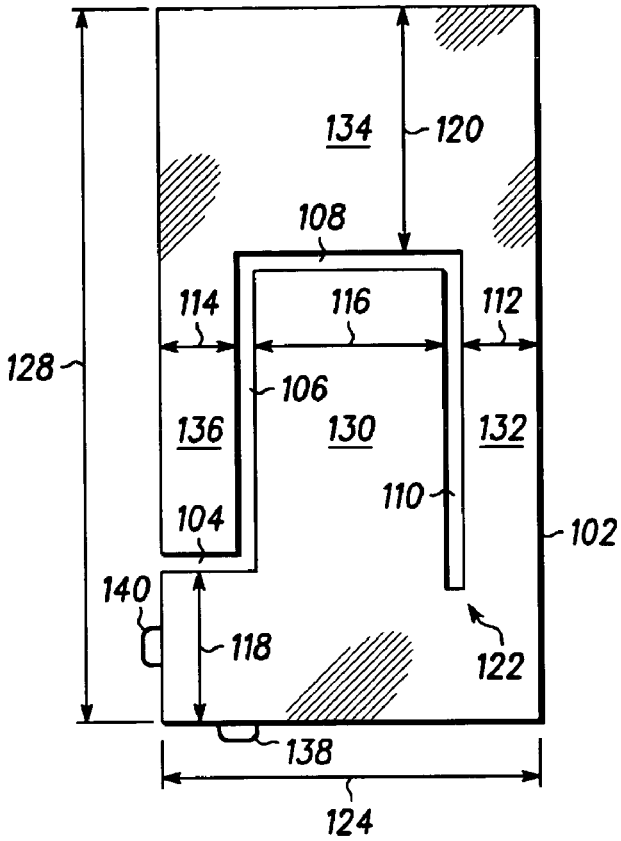
FIG. 1 a top view of a PIFA antenna that is used as part of a PIFA-Parasitic Element combination antenna, according to a preferred embodiment of the present invention.

A top view of a PIFA antenna 100 as is used by a PIFA-PE combination antenna according to an exemplary embodiment of the present invention is illustrated in FIG. 1. The PIFA antenna 100 consists of a rectangular conductive sheet 102 into which a slot 122 is cut. Rectangular conductive sheet 102 in this exemplary embodiment is a 0.2 mm thick sheet of copper that has a width 124 of 20 mm and a length 128 of 38 mm. The slot 122 in this exemplary embodiment has a first section 104, a second section 106, a third section 108 and a fourth section 110. All sections of the slot 122 in this exemplary embodiment have a width of 1 mm. The first section 104 of slot 122 in this exemplary embodiment begins at the left edge of the rectangular conductive sheet 102 and extends into the sheet 5 mm. The first section 104 is located at a first distance 118 from the bottom edge of the rectangular conductive sheet 102. The first distance 118 in this exemplary embodiment is 8 mm. The second section 106 of conductive sheet 122 in this exemplary embodiment forms a right angle with the end of the first section 104 and extends 17 mm. The second section in this exemplary embodiment is a second distance 114 from the edge of the rectangular conductive sheet 102. The second distance 114 in this exemplary embodiment is 4 mm. The third section 108 of slot 122 in this exemplary embodiment forms a right angle with the end of the second section 106 that is opposite the first section 104 and extends for 12 mm. The third section 108 is located a third distance 120 from the edge of the rectangular conductive sheet 102. The third distance in this exemplary embodiment is 13 mm. The fourth section 110 of slot 122 in this exemplary embodiment forms a right angle with the end of the third section 108 that is opposite the second section 106 and extends for 18 mm. The fourth section 110 is located a fourth distance 112 from the edge of the rectangular conductive sheet 102. The fourth distance in this exemplary embodiment is 4 mm. The second section 106 and the fourth section 110 in this exemplary embodiment are substantially parallel and separated by a fifth distance 116, which is 10 mm in this exemplary embodiment.

The exemplary PIFA antenna 100 includes a high frequency portion 130 and a low frequency portion that consists of a first PIFA arm 132, a second PIFA arm 134 and a third PIFA arm 136. These two portions operate to provide the dual frequency characteristics of the exemplary PIFA antenna 100 operating alone. The exemplary PIFA antenna 100 further has an RF lead 138 and a ground connector 140, as are described in more detail below.

Figure 2:
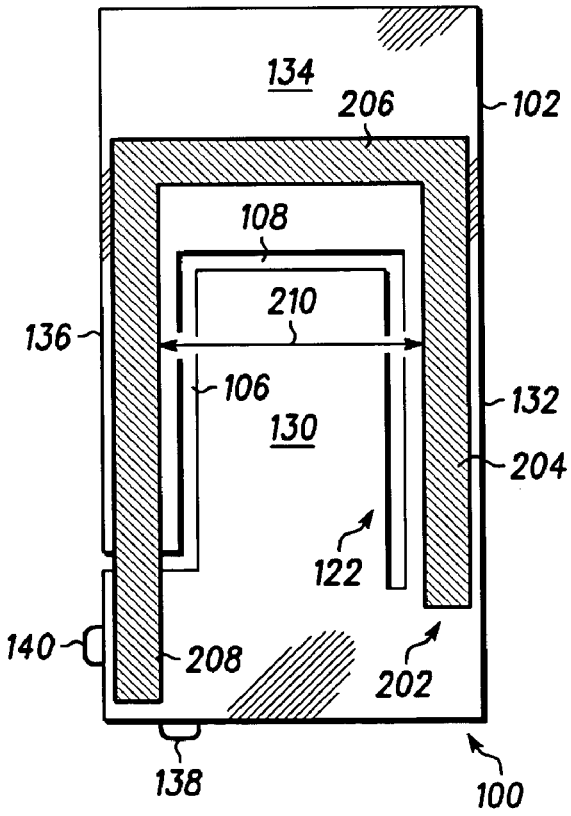
FIG. 2 a top view of a PIFA-Parasitic Element combination antenna, according to a preferred embodiment of the present invention.

A top view of a PIFA-PE combination antenna 200 according to an exemplary embodiment of the present invention is illustrated in FIG. 2. The PIFA-PE combination 200 of the exemplary embodiment has a PIFA 100 and a Parasitic Element (PE) 202 arranged in a vertical proximity to each other so that the PE 202 is operationally coupled to the PIFA 100. PIFA 100 of the exemplary embodiment is a conventional PIFA antenna and embodiments of the present invention are able to incorporate any conventional PIFA design.

The PE 202 of the exemplary embodiment has a first parasitic arm 204, a second parasitic arm 208 and a connecting parasitic arm 206. The PE 202 of the exemplary embodiment is formed from conductors that have a width of 2.4 mm. There is no ohmic contact to support electron current flow between the PIFA 100 and the PE 202 in the exemplary embodiment. The PE 202 of the exemplary embodiment is in a plane that is essentially parallel to the plane of the PIFA 100. The first parasitic arm 204 has a length of 25 mm and the second parasitic arm 208 has a length of 30 mm. The first parasitic arm 204 and the second parasitic arm 208 are substantially parallel in this exemplary embodiment and are separated by a parasitic separation distance 210, which is 14 mm in this exemplary embodiment. The connecting parasitic arm 206 forms essentially right angles with the first parasitic arm 204 and the second parasitic arm. The PE 202 of this exemplary embodiment has a shape that generally conforms to the shape of the PIFA 100 with which it operates. Alternative embodiments of the present invention include parasitic elements that do not form parallel structures and have junctions between sections that are not at right angles. Yet other alternative embodiments utilize parasitic elements that have shapes that do not generally conform to the shape of the PIFA with which they operate. Embodiments of the present invention place a parasitic element with other orientations relative to the PIFA to which it is operationally coupled.

Figure 3:
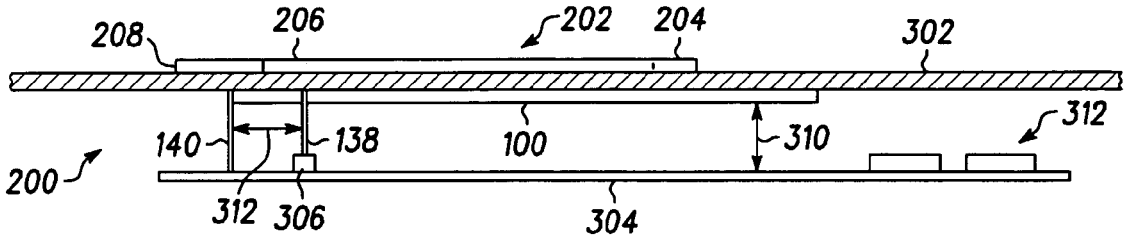
FIG. 3 a side view of a PIFA-Parasitic Element combination antenna as installed into a portable communications device, according to a preferred embodiment of the present invention.

A side view 300 of a PIFA-PE combination antenna 200 that is mounted in an exemplary wireless communications device according to an exemplary embodiment of the present invention is illustrated in FIG. 3. The PIFA-PE combination antenna 200 is shown to have a PIFA antenna 100 and a parasitic element (PE) 202. The PIFA 100 and PE 202 are separated in this exemplary embodiment by housing plastic 302. The housing plastic 302 of the exemplary embodiment has a thickness of 1 mm and a dielectric constant (Er) of 4. The PIFA 100 is mounted above a printed circuit board (PCB) 304 at a mounting height 310, which is 8 mm in this exemplary embodiment. The PCB 304 of the exemplary embodiment is 95 mm long, 2 mm thick and is constructed of FR-4 with copper conductors. The PCB 304 further includes digital, analog and RF circuit components 312 for the exemplary wireless communications device. The PCB 304 of this exemplary embodiment also has an RF connector 306 to provide ohmic coupling of RF signals between the circuit components 312 and the PIFA antenna 100. The PIFA antenna 100 is connected to the RF connector 306 by an RF lead 138. The RF lead 138 of the exemplary embodiment is constructed of 0.2 mm thick copper and is 2 mm wide. The RF lead 138 is placed along an edge of the rectangular conductive sheet 102 at a connector distance 312 from the adjoining edge of the rectangular conductor sheet 102. The conductor distance 312 in this exemplary embodiment is 4 mm. The PIFA antenna 100 further has a ground contact 140 that is located on that adjoining edge of the rectangular conductive sheet 102 at a point that is 4 mm from the edge on which the RF lead 138 is attached. The ground contact 140 of the exemplary embodiment is 4 mm wide and similarly constructed of 0.2 mm thick copper.

Alternative embodiments of the present invention are able to have the PE placed in any of a number of different locations and orientations relative to the PIFA 100 that support the coupling between the PE 202 and PIFA 100 as is described below. The structure of the PE is also not limited to the linear structures chosen for ease of understanding in the example. The PE 202 preferably conforms to an enclosure or other physical structure that forms the housing for the device using the PIFA-PE antenna structure 200. The shape of the PIFA 100 is also able to vary as is known and understood by practitioners in the relevant arts and as described below.

Figure 4:
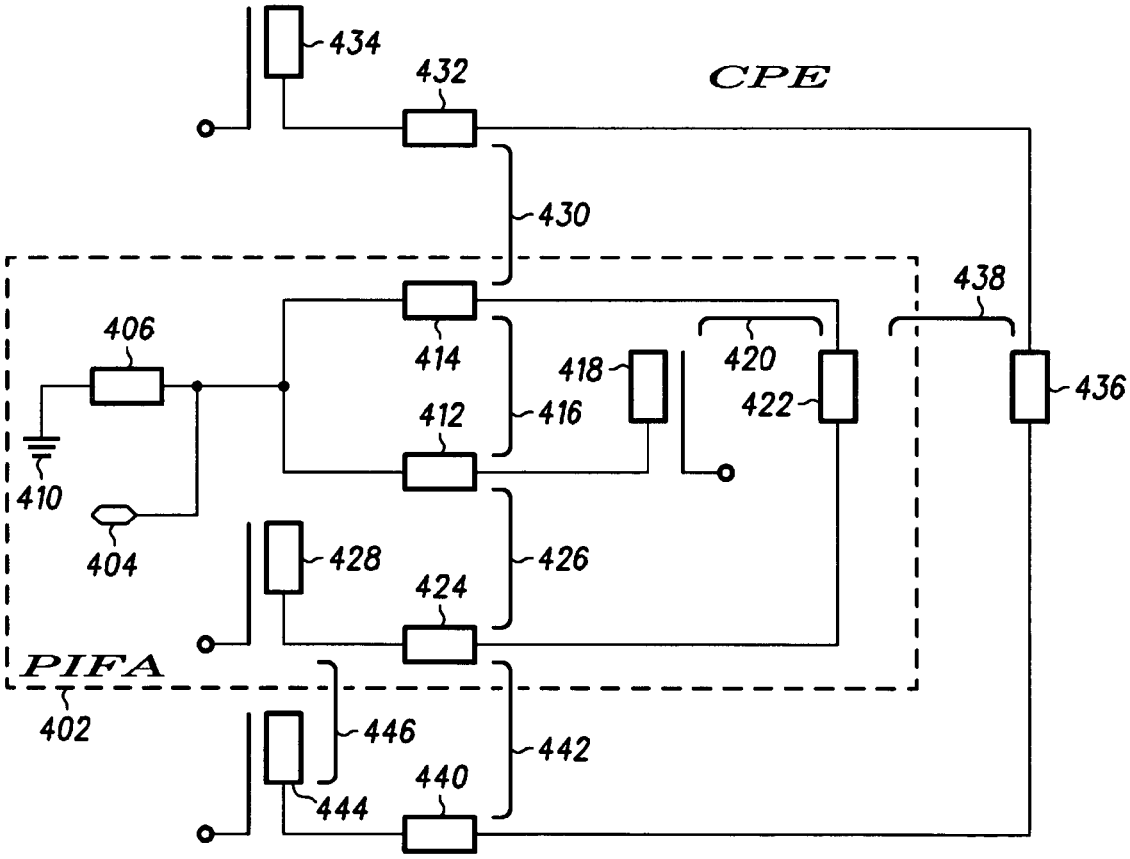
FIG. 4 is a lumped element electrical diagram for a PIFA-Parasitic Element combination antenna, according to a preferred embodiment of the present invention.

A lumped element electrical diagram 400 for a PIFA-PE combination 200 of the exemplary embodiment is illustrated in FIG. 4. The lumped element electrical diagram 400 represents portions of the conductive structures of the PIFA 100 and PE 202 as reactive elements and further shows electromagnetic coupling between these conductive structure portions. Elements that are part of the same conductive structure are shown as electrically connected to adjacent element by lossless conductors. The elements of the PIFA 100 of the exemplary are depicted within the dotted line 402 and elements of the PE 202 of the exemplary embodiment are depicted outside of the dotted line 402. This description will first discuss the reactive elements that model the PIFA 100 and then discuss the reactive elements that model the PE 202 and the radiant couplings between those two structures.

The RF input 404 is shown as connected to a RF input reactive element 406, which represents the electrical characteristics of the RF lead 138, ground connector 140 and other portions of the PIFA 100 at the RF frequency of interest. The other end of the RF input reactive element 406 is connected to ground 410. The RF input 404 is further shown as connected to the input of a first PIFA element 412 and a second PIFA element 414. The first PIFA element 412 represents part of the high frequency portion 130 of the PIFA 100. The output of the first PIFA element 412 is connected to the input of a third PIFA element 418, which represents the open circuit portion of the high frequency portion 130 and is shown as an open circuit transmission line. The second PIFA element 414 represents the portion of the first PIFA arm 132 that radiantly couples to the first parasitic arm 204. The first PIFA element 412 and the second PIFA element 414 are shown to be electromagnetically coupled by a first coupling 416. The output of the second PIFA element 414 is connected to the input of a fourth PIFA element 422. The fourth PIFA element 422 represents the second PIFA arm 134. The fourth PIFA element 422 is shown to be electromagnetically coupled to the third PIFA element 418 through a second electromagnetic coupling 420. The output of the fourth PIFA element 422 is connected to the input of a fifth PIFA element 424. The fifth PIFA element 424 represents the portion of the third PIFA arm 136 that radiantly couples to the second parasitic arm 208. The fifth PIFA element has an electromagnetic coupling to the first PIFA element 412 in this exemplary embodiment, as is represented by a third coupling 426. The output of the fifth PIFA element 424 is connected to the input of a sixth PIFA element 428. The sixth PIFA element 428 represents the open circuit portion of third PIFA arm 136 and is shown as an open circuit transmission line.

The PE 202 of the exemplary embodiment is a separate conductive structure that is positioned in proximity to the PIFA 100 so as to allow radiant coupling of RF energy between the PIFA 100 and the PE 202. The PE 202 of the exemplary embodiment is a generally "U" shaped structure that has a shape that roughly corresponds to the shape of the conductive portions of the PIFA 100. Alternative embodiments of the present invention incorporate PE structures that have shapes that do not correspond to the PIFA antenna to which it is radiantly coupled and with which it is operating.

The lumped element electrical diagram 400 for a PIFA-PE combination 200 shows that the second PIFA element 414 is electromagnetically coupled to a first PE element 432. The first PE element 432 represents the portion of first parasitic arm 204 that appreciably radiantly couples to first PIFA arm 132. One output of the first PE element 432 is connected to a second PE element 434, which represents the open circuit portion of the end of the first parasitic arm 204 in this exemplary embodiment. The first PE element 432 is also electromagnetically coupled to the second PIFA element 414 by a fourth radiantly coupling 430. The other part of the first PE element 432 is connected to one part of a third PE element 436. The third PE element 436 corresponds to connecting parasitic arm 206 and radiantly couples to the fourth PIFA element 422 in the exemplary embodiment by a fifth radiantly coupling 438. The other part of the third PE element 436 is connected to a part of a fourth PE element 440. The fourth PE element 440 corresponds to the second parasitic arm 208 of PE 202. The fourth PE element 440 couples to the fifth PIFA element 424 through a sixth radiantly coupling 442. The other part of the fourth PE element 440 is connected to a fifth PE element 444, which is an open end transmission line. The fifth PE element is coupled to the sixth PIFA element 428 by a seventh radiantly coupling 446.

The electromagnetic (radiantly) couplings described above between the PE 202 and the PIFA 100 induce currents in the PE 202 and cause the PE 202 to become part of the radiation structure of the PIFA-PE combination 200. An exemplary PIFA only radiation characteristic verses RF frequency 500 of a PIFA antenna operating without a parasitic element is illustrated in FIG. 5. The exemplary radiation characteristic 500 has a horizontal scale that is an RF frequency scale 502 that extends from 800 MHz to 2000 MHz. The vertical scale 504 indicates two values. The negative values on the vertical scale indicate the reflection loss (RL) of the input into the antenna expressed in decibels (dB). The positive values indicate the radiation efficiency of the antenna, expressed as a percentage. Reflection loss in this graph indicates the amount of RF energy that is reflected back to an RF generator driving the input to the antenna, relative to the amount of RF energy being delivered to the antenna. The reflected energy is not available for transmission, so a more negative reflection loss value is indicative of better antenna performance.

The graph of the exemplary PIFA radiation characteristic 500 has two traces. A reflection loss trace 508 indicates reflection loss of the antenna as a function of frequency. An efficiency trace 506 indicates the radiation efficiency of the antenna as a function of frequency. The exemplary radiation characteristic 500 indicates two peaks in the efficiency trace 506, a first peak 510 near 850 MHz and a second peak 512 near 1.9 GHz. The reflection loss trace 508 corresponds to the efficiency trace 506 and similarly has two peaks, a first peak 514 near 850 MHz and a second peak 516 near 1.9 GHz. This response indicates that this PIFA type antenna, which utilizes a conventional PIFA design, is suitable for use in a dual band cellular telephone that is able to communicate in either of two bands, one band in the region of 800 MHz and another band in the region of 1.9 GHz.

An exemplary PIFA-PE combination antenna structure radiation characteristic verses RF frequency 600 as is characteristic of the exemplary embodiment of the present invention is illustrated in FIG. 6. The exemplary PIFA-PE combination radiation characteristic 600 shares the RF frequency scale 502 and vertical scale 504 with the exemplary PIFA radiation characteristic 500. The exemplary PIFA-PE combination radiation characteristic 600 also has two traces, a PIFA-PE reflection loss trace 604 and a PIFA-PE radiation efficiency trace 602. The PIFA-PE reflection loss trace 604 maintains the two peak values of the PIFA reflection loss trace 508, i.e., the first RL peak 514 near 850 MHz and the second RL peak 516 near 1.9 GHz. In addition to those two peaks, the PIFA-PE reflection loss trace 604 of the exemplary embodiment also includes a third RL peak 608 near 1.575 GHz. This third RL peak 608 is a result of the altering of the radiation characteristics caused by the radiantly coupling between the PIFA 100 and the PE 202 of the exemplary embodiment. The PIFA-PE radiation efficiency trace 602 similarly has the original peaks near 850 MHz and 1.9 GHz with an additional third radiation efficiency peak 606 near 1.575 GHz.

The parasitic element 202 of the exemplary embodiments is configured and positioned relative to the PIFA 100 so that it works in conjunction with a PIFA 100 so as to further induce the wireless characteristic of the PIFA 100 within an additional frequency band compared to the wireless characteristic of the PIFA 100 in that frequency band when the PIFA 100 is operating alone. The lengths of the first parasitic arm 204 and second parasitic arm 206, as well as their arrangement and separation, affect the center frequency of this band. Variations in the length of one or both of these arms, as well as the separation between these arms, allows modification of the center frequency of the additional RF band that is added to the PIFA 100. Embodiments that use a parasitic element with different shapes, including shapes that are selected to conform to a nearby surface such as a cellular telephone case, also are able to have the shape of the parasitic elements altered so as to affect the additional frequency band that is provided by the PIFA-PE antenna structure 200.

A cross-sectional view 700 of an alternative PIFA-PE antenna combination arrangement, shown as part of an exemplary cellular telephone 706 incorporating an alternative PIFA-PE antenna structure 720, according to an alternative embodiment of the present invention is illustrated in FIG. 7. Note that the exemplary cellular telephone 706 is representative of a wireless device, e.g., cell phone, two-way portable radio, wireless communicator, and other such devices, that can be used for at least one of wireless transmission of signals from a transmitter and wireless reception of transmitted signals by a receiver. The exemplary cellular telephone cross-sectional view 700 presents a side view of the exemplary cellular telephone 706. The exemplary cellular telephone cross-sectional view 700 shows a circuit board 702 that is mounted within a plastic case 704. The circuit board 702 of this exemplary cellular telephone 706 includes circuitry 712 for analog, digital and RF signal processing as is conventionally included in cellular telephones. This cellular telephone 706 includes a single antenna structure 710 that includes a PIFA 100 and a Parasitic Element (PE) 708.

This exemplary cellular phone 706 is designed to communicate in two communications RF bands, a cellular telephone RF band in the region of 800 MHz and another cellular telephone RF band in the region of 1.9 GHz. In addition to communicating in these two RF bands, this exemplary cellular telephone 706 receives GPS signals in the RF band in the region of 1.575 GHz. The antenna structure 720 of this exemplary cellular telephone operates efficiently in all three of these bands and advantageously obviates the need for a separate GPS antenna.

The PIFA 100 is mounted on the circuit board 702 of this exemplary cellular telephone 706. This exemplary cellular telephone 706 uses a conventional PIFA 100 that operates in the two cellular telephone bands. A Conformal Parasitic Element (CPE) 708 is placed on the inside of the plastic case 704, which is a surface that is separated from the PIFA 100 in this exemplary embodiment, so as to properly position the CPE 708 so as to induce improved radiation of the PIFA 100 within an additional frequency band, in this case the GPS signal RF band in the region of 1.575 GHz. The CPE 708 of this embodiment conforms to the surface of the inside of the case 704, thereby facilitating manufacture of the cellular telephone 706. Alternative embodiments place a CPE 708 on the outside or on top of the PIFA 100 itself using, for example a thin, non conductive substrate. Also, embodiments construct both the PIFA 100 and the CPE 708 in one substrate, such as a FLEX circuit, and mount this assembly directly on a printed circuit board. The CPE 708 operates similarly to the parasitic element 202 described above. The coupling between the CPE 708 and the PIFA 100 is able to be controlled, for example, by adjusting either the relative spacing and/or location of these two elements, by adjusting the width of the elements of the CPE 708, or by placing a dielectric material between the CPE 708 and the PIFA 100. The CPE 708 of this exemplary cellular telephone 706 is printed onto the plastic case 704 with conductive material in order to facilitate economic manufacture of the cellular telephone 706 and the antenna structure 100. Alternative embodiments place the CPE 708 about the surface of the plastic case 704, such as by embedding conductors into the plastic case 704 to form the CPE 708. Other embodiments place the CPE 708 about the case 704 by using a vacuum depositing method to place conductive lines onto the case of the device, attaching the CPE 708 on or near the case by using adhesives or other mechanisms. Affixing the parasitic element with adhesives, for example, is usually facilitated by the use of fiducial points placed on the surface to which the parasitic element is to be affixed. The use of a Conformal Parasitic Element 708 for the parasitic element of a PIFA-PE combination antenna structure allows the CPE 708 to be added to product designs that already use a PIFA. The CPE 708 is able to be placed on any surface that is separated from, i.e., is not a part of, the PIFA with which it operates. A conformal parasitic element is able to be added to such a device without impact to the packaging shape of the product.

In addition to the straight conductors of the first parasitic arm 204 and second parasitic arm 208, alternative embodiments have one or more conducting sections of the parasitic element that have a meandering shape. Meandering of the conductive sections causes the parasitic element to resonate at different frequencies. A parasitic element with meandering sections thereby produces a combined PIFA-PE antenna structure that adds two or more RF bands to the RF bands exhibited by the PIFA operating alone. This allows for efficient operation in a number of bands that is determined by the structure of the parasitic element of the particular embodiment.

Figure 8:
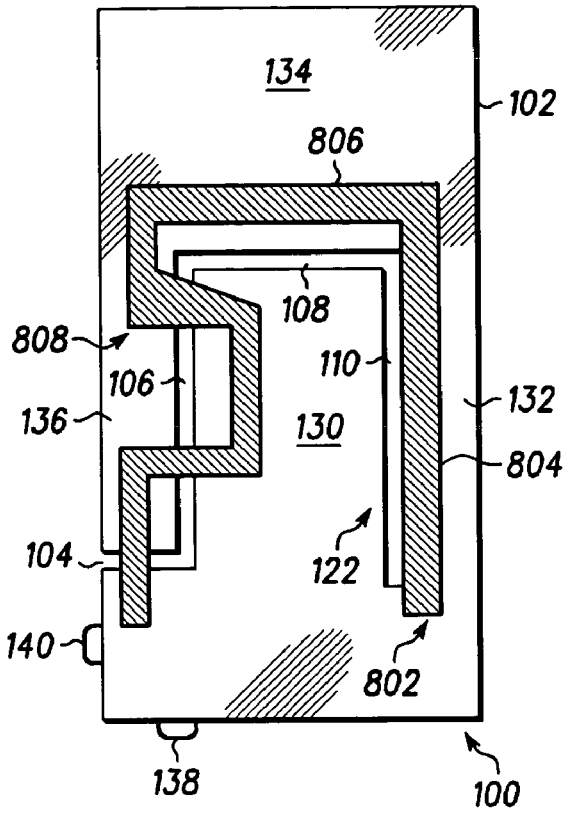
FIG. 8 is a top view of a PIFA-Parasitic Element antenna structure that incorporates a meandering parasitic element, according to an alternative embodiment of the present invention.

An alternative PIFA-PE antenna combination 800 that has an exemplary meandering parasitic element 802 is illustrated in FIG. 8. The alternative PIFA-PE antenna combination 800 includes a PIFA antenna 100 that is similar to the PIFA antenna 100 described above. The alternative PIFA-PE antenna combination 800 includes an exemplary meandering parasitic element 802. The meandering parasitic element 802 is separated from the PIFA antenna 100 by a 1 mm thick plastic housing as is described for the exemplary PIFA-PE antenna combination 200 described above. The exemplary meandering parasitic element 802 has a first meandering element 804 that is a straight conductor in this exemplary embodiment. The meandering parasitic element 802 further has a second meandering element 808 as is illustrated. The second meandering element 808 has a meandering configuration as is shown. The meandering configuration of the second meandering element 808 provides one or more additional resonant frequencies in the alternative PIFA-PE antenna 800.

An additional advantage of the PIFA-PE antenna structure in a handheld and/or portable device is that a properly designed parasitic element 202 acts to pre-load the PIFA antenna 100 and to thereby minimize the effects of a user's hand or other conductive material on the operation of the antenna structure 200 compared to a PIFA 100 operating alone. Generally, the design of conductive surfaces to pre-load antennas is known by practitioners in the relevant arts. The use of conductive printing or other low cost methods of creating the parasitic element further minimizes the manufacturing cost of the complete antenna structure 200.

Figure 9:
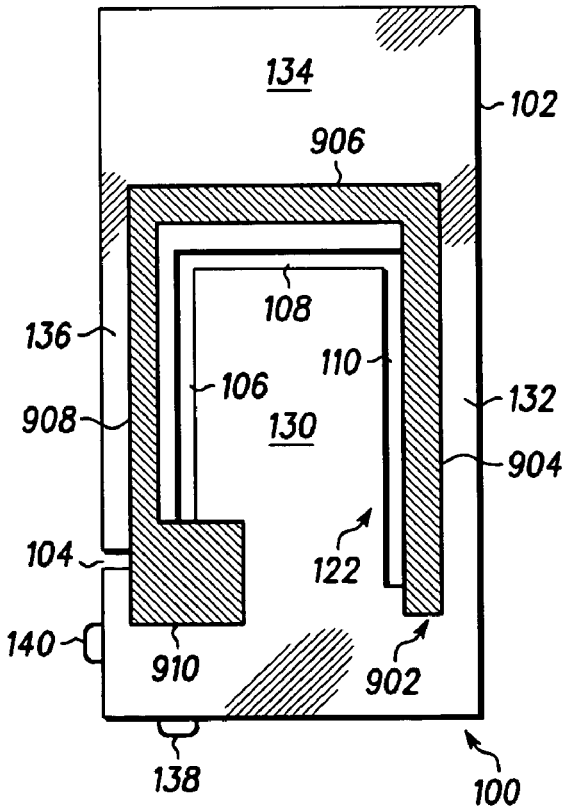
FIG. 9 is a top view of a pre-loading PIFA-Parasitic Element antenna structure, according to an alternative embodiment of the present invention.

An exemplary pre-loading PIFA-PE antenna combination 900 according to an alternative embodiment of the present invention is illustrated in FIG. 9. The exemplary pre-loading PIFA-PE antenna combination 900 includes a PIFA antenna 100 that is similar to the PIFA antenna 100 that is described above. The exemplary pre-loading PIFA-PE antenna combination 900 further includes a pre-loading parasitic element 902. The pre-loading parasitic element 902 of this exemplary embodiment includes a first pre-loading parasitic element 904 and a connecting pre-loading parasitic element 906 that are constructed of straight lengths of conductor. The pre-loading parasitic element 904 has a second pre-loading parasitic element 908 that is parallel to the first pre-loading parasitic element 904. The end of the second pre-loading parasitic element 908 has a pre-load 910 that is included to minimize the effect of a user's hand near the high impedance end of the pre-loading parasitic element 904. The design of the pre-loading parasitic element 904 is adjusted to accommodate the presence of the pre-load 910 and maintain operation of the exemplary pre-loading PIFA-PE antenna combination 900 within the GPS signal band.

The use of a conformal parasitic element 202 allows selective incorporation of the additional band into products with the same circuit board that contains a PIFA 100. The PIFA is able to operate in its conventional RF bands without the parasitic element, or the board is able to be incorporated into a case with a conformal parasitic element 202 contained in that case and thereby operate in an additional band.

The use of a parasitic element to add a frequency band to a PIFA antenna allows the addition of one or more bands to the composite antenna structure without an increase in complexity to the electronic circuit or circuit board layout of the device using the combined PIFA-PE antenna. The use of a conformal parasitic element that is affixed to or part of the case of the device using the combined PIFA-PE structure further allows an antenna structure to be created that has a maximum volume given the constraints of the case of the device.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. An antenna, comprising:

a PIFA for wireless operation within at least one frequency band; and a parasitic element positioned to be operatively coupled to the PIFA, wherein the parasitic element is obmically isolated from ground, and wherein RF energy is radiantly coupled between the parasitic element and the PIFA, and the parasitic element is configured and positioned so as to further induce wireless operation of the PIFA within at least one additional frequency band;

wherein the PIFA is mounted above a ground plane, the PIFA having a first side facing a plane containing the ground plane and wherein the parasitic element is located above a second side of the PIFA that is opposite the first side.

2. The antenna of claim 1, wherein the parasitic element comprises three ohmically connected arms that join at substantially right angles and that radiantly couple to at least three arms of the PIFA.

3. The antenna of claim 1, wherein the parasitic element comprises three ohmically connected arms that are arranged in a shape that generally conforms to the shape of the PIFA.

4. The antenna of claim 1, wherein the parasitic element comprises a meandering section.

5. The antenna of claim 1, wherein the parasitic element conforms to a surface that is above the PIFA.

6. The antenna of claim 5, wherein the parasitic element is mounted on the surface, wherein the surface is between the PIFA and the parasitic element, the surface comprises at least a portion of a case of a wireless communications device.

7. The antenna according to claim 6, wherein the PIFA is in contact with a first side of the surface and the parasitic element is in contact with an opposite side of the surface, the opposite side being opposite the first side.

8. A parasitic element for use with a PIFA antenna that is for wireless operation within at least one frequency band, the parasitic element comprising:

at least two conductors arranged so as to radiantly couple RF energy between the parasitic element and the PIFA antenna, wherein the parasitic element is configured and positioned relative to the PIFA antenna so as to further induce wireless operation of the PIFA antenna within at least one additional frequency band and wherein the parasitic element is ohmically isolated from ground;

wherein the parasitic element conforms to a surface that is above the PIFA and the parasitic element is mounted on the surface, wherein the surface is between the PIFA and the parasitic element, the surface comprises at least a portion of a case of a wireless communications device.

9. A method comprising:

parasitically inducing a radiation characteristic of a PIFA antenna, that wirelessly operates within at least one frequency band, resulting in wireless operation thereof within at least one additional frequency band by radiantly coupling RF energy from the PIFA antenna to a parasitic element that is ohmically isolated from ground;

wherein the parasitically inducing comprises positioning the parasitic element so as to be operatively coupled to the PIFA antenna so as to induce the radiant coupling of RF energy between the PIFA antenna and the parasitic element, wherein the positioning contributes to the parasitically inducing and wherein the parasitic element comprises a conductor ohmically isolated from around;

wherein the parasitic element conforms to a surface that is above the PIFA antenna and the parasitic element is mounted on the surface and the surface comprises at least a portion of a case of a wireless communications device.

10. The method according to claim 7, wherein the parasitic element comprises three ohmically connected arms that are arranged in a shape that generally conforms to the shape of the PIFA antenna.

11. The method according to claim 7, wherein the parasitic element comprises a meandering section so as to further induce radiation characteristics of the PIFA antenna in an additional plurality of bands.

12. A wireless communications device, comprising:

at least one of a receiver for wirelessly receiving transmitted signals and a transmitter for wirelessly transmitting signals;

a PIFA antenna, electrically coupled to the at least one of a receiver and a transmitter, for wireless operation within at least one frequency band; and a parasitic element, positioned so as to be operatively coupled to the PIFA antenna, for radiantly coupling RF energy between the parasitic element and the PIFA antenna, the parasitic element being configured and positioned so as to further induce radiation of the PIFA antenna within at least one additional frequency band, wherein the parasitic element is ohmically isolated from ground;

wherein the parasitic element conforms to a surface that is above the PIFA and the surface comprises at least a portion of a case of the wireless communications device.

13. The wireless communications device of claim 12, wherein the parasitic element comprises three ohmically connected arms that are arranged in a shape that generally conforms to the shape of the PIFA antenna.

* * * * *